US007997224B2

(12) United States Patent
Owen et al.

(10) Patent No.: US 7,997,224 B2
(45) Date of Patent: Aug. 16, 2011

(54) PAYLOAD DEPLOYMENT SYSTEM FOR A SUBMARINE

(75) Inventors: Bryan Jeffery Owen, Bristol (GB); Dale Michael Jeffreys, Bristol (GB); Peter David Clarke, Bristol (GB); Jeremy William Smith, Ploerdut (FR)

(73) Assignee: Babcock Integrated Technology Limited, Bristol (GB)

( * ) Notice: Subject to any disclaimer, the term of this patent is extended or adjusted under 35 U.S.C. 154(b) by 316 days.

(21) Appl. No.: 12/091,198

(22) PCT Filed: Oct. 24, 2006

(86) PCT No.: PCT/GB2006/003932
§ 371 (c)(1),
(2), (4) Date: Aug. 6, 2008

(87) PCT Pub. No.: WO2007/049015
PCT Pub. Date: May 3, 2007

(65) Prior Publication Data

US 2009/0158990 A1 Jun. 25, 2009

(30) Foreign Application Priority Data

Oct. 24, 2005 (GB) ..... 0521649.4

(51) Int. Cl.
*F41F 3/08* (2006.01)

(52) U.S. Cl. ..... 114/238; 89/1.809

(58) Field of Classification Search ..... 124/57, 124/58, 61, 71; 42/1.14, 54; 89/5, 1.809, 89/1.81, 1.815, 1.816, 1.819; 114/238, 239, 114/316, 319; 244/63
See application file for complete search history.

(56) References Cited

U.S. PATENT DOCUMENTS

| | | | | |
|---|---|---|---|---|
| 801,719 | A * | 10/1905 | Jones | 114/238 |
| 826,019 | A * | 7/1906 | Crosse | 482/26 |
| 1,336,110 | A | 4/1920 | Turcan | |
| 1,526,256 | A * | 2/1925 | Techel | 114/238 |
| 1,907,499 | A | 5/1933 | Champness | |
| 3,158,124 | A * | 11/1964 | Chevillon | 114/21.1 |
| 3,363,508 | A * | 1/1968 | Stahmer | 89/1.818 |
| 3,807,274 | A | 4/1974 | Cohen | |
| 4,616,554 | A * | 10/1986 | Spink et al. | 89/1.806 |
| 5,834,674 | A * | 11/1998 | Rodriguez et al. | 89/1.81 |
| 6,354,182 | B1 * | 3/2002 | Milanovich | 89/1.818 |
| 6,530,305 | B1 * | 3/2003 | MacLeod et al. | 89/1.81 |
| 6,568,309 | B2 * | 5/2003 | MacLeod | 89/1.81 |
| 6,672,239 | B1 * | 1/2004 | Gieseke | 114/316 |
| 2005/0242230 | A1 | 11/2005 | Vallier | |
| 2006/0086349 | A1 * | 4/2006 | Kamen et al. | 124/71 |

FOREIGN PATENT DOCUMENTS

| | | |
|---|---|---|
| DE | 44255 | 12/1886 |
| DE | 1506360 | 1/1970 |
| DE | 3702605 | 8/1988 |
| EP | 0295600 | 12/1988 |
| EP | 0526831 | 2/1993 |
| EP | 00545877 | 6/1993 |
| FR | 796393 | 4/1936 |
| GB | 378978 | 7/1932 |

* cited by examiner

*Primary Examiner* — Bret Hayes
*Assistant Examiner* — Reginald Tillman, Jr.
(74) *Attorney, Agent, or Firm* — Stites & Harbison PLLC; Douglas E. Jackson

(57) ABSTRACT

A payload deployment system for a vessel, such as a submarine, which includes a cable extending between a piston in a piston tube and an ejection element in an ejection tube, wherein the ejection tube is suitable for holding the payload, such as a torpedo. The system is arranged such that movement of the piston in the piston tube causes movement of the cable which, in turn, exerts a force on the ejection element to move it in the ejection tube to eject the payload from the ejection tube.

15 Claims, 6 Drawing Sheets

PAYLOAD DEPLOYMENT SYSTEM FOR A SUBMARINE

BACKGROUND OF THE INVENTION

1. Field of the Invention

The field of this invention relates to systems for deploying payloads from vessels, e.g. submarines, and in particular, systems for launching stores (e.g. torpedoes) from submarines.

2. Summary of the Prior Art

Conventional torpedo launch systems utilise fluid pressure to force a torpedo from a torpedo launch tube.

An example of a known torpedo launch system is described in European Patent No. EP 0526831 B. The system includes a torpedo launch tube, in which a torpedo is located prior to launch. A piston tube is provided adjacent the torpedo launch tube, the piston tube having a piston therein which is arranged to slide along the piston tube upon the application of fluid pressure (from compressed air). The piston tube includes a slot through which a projection of the piston extends. The piston projection is arranged to engage the torpedo such that, when the piston slides along the piston tube, the piston projection pushes the torpedo out of the torpedo tube.

However, problems arise with leakage of compressed air from the piston tube, through the slot. Leakage of compressed air reduces the fluid pressure in the piston tube, and thus the force at which the piston is slid along the piston tube. In an attempt to overcome this problem, a tongue seal is provided along the slot. However, providing a perfect seal along the entire length of the slot, whilst still permitting the piston projection to travel along the slot, is virtually impossible.

European Patent No. EP 0295600 B describes a conveyor device for loading and unloading torpedoes in a torpedo tube. The device includes a piston fixed through a piston rod to the torpedo tube, and a cylinder displaceable relative to the piston. A slide, on which a loading platform for an object is attachable, is mounted on the exterior of the cylinder and is driven, during movement of the cylinder relative to the piston, via a cable line. The cable line is located outside the cylinder, has ends securely connected to the torpedo tube, and runs over deflecting rollers in such a way that, during a cylinder stroke, the slide also moves along the cylinder. With this arrangement, the slide covers a greater distance than the cylinder relative to the piston, during a cylinder stroke.

SUMMARY OF THE INVENTION

At its most general, the present invention provides: a payload deployment system for a vessel, such as a submarine, the system comprising an ejection tube and a piston tube, wherein the ejection tube includes an element for ejecting a payload from the ejection tube, the element being connected to a piston in the piston tube via a cable that extends to the piston through a sealing means of the piston tube; and a vessel, e.g. a submarine, including the system.

Thus, according to a first aspect of the invention there may be provided:

a payload deployment system for a vessel, the system including:

an ejection tube for holding a payload;

an ejection element in the ejection tube, the ejection element being moveable in the ejection tube and being arranged releasably to engage the payload;

a piston tube containing a moveable piston and defining a piston chamber on one side of the piston;

a cable connected between the piston and the ejection element, the cable passing through an aperture of the piston tube into the piston chamber; and means for supplying compressed gas or fluid to the piston chamber, thereby to move the piston in the piston tube;

the movement of the piston being arrange to cause the ejection element to move in the ejection tube, thereby to eject the payload from the ejection tube.

In the present invention, the cable may be made of wire, synthetic rope (man made) or aramid rope, or could be made from a synthetic or aramid tape.

The aperture may be a hole in a element through which the cable passes. The hole may be of similar or identical diameter to the cable, such that the cable essentially fills the hole, preventing escape of gas or fluid through the hole. A sealing element may define an opposite end of the piston chamber to the piston. The sealing element may be integral with, or provided by, walls of the piston tube, or may be fixed in position inside the piston tube. The sealing element may have a profile that conforms with the inner walls of the piston tube, so that gas or fluid is prevented from leaking from the piston chamber around the edges of the sealing element.

When, in use, the piston moves, force may be transmitted from the piston to the ejection element via the cable. The cable may be fixed to the ejection element and fixed to the piston. However, such fixing is not essential to achieve the force transmission. As an alternative, for example, the cable may be arranged to pass over a pulley wheel rotatably mounted on the ejection element and/or over a pulley wheel rotatably mounted on the piston, with the ends of the cable being e.g. anchored to points on the ejection tube/piston tube.

The means for supplying compressed gas or fluid to the piston chamber may be a compressed air vessel connected to the piston chamber via a firing valve. Upon release of the firing valve, compressed air flows may flow into the piston chamber, thus causing the piston to move.

Preferably, the vessel is a submarine. Preferably, the deployment system includes the payload, the payload being located in the payload ejection tube.

The deployment system of the present invention is particularly appropriate for launching a store (e.g. a torpedo) from a submarine (the payload being the store).

The ejection element may releasably engage with the payload prior to movement of the piston, or may releasably engage with the payload only after the piston has begun to move.

The longitudinal axis of the ejection tube and the longitudinal axis of the piston tube may be parallel with each other, and the ejection tube and the piston tube may abut one another. This configuration may allow the system to take a compact form. The ejection tube and the piston tube may have the same or similar lengths.

Preferably, when the compressed gas or fluid causes the piston to move in the piston tube, the ejection element moves in an opposite direction to the piston.

Movement of the ejection element and the piston in opposite directions may be achieved by running the connecting cable over a cable runner (essentially a wheel or a plurality of wheels). The cable runner may change the direction in which the cable travels (as the cable runs over it) and therefore the direction that forces may be transferred between the piston and the ejection element. The cable runner is preferably located in or adjacent an opening of the piston tube.

The piston tube may include a vent which is arranged to vent air compressed forward of the piston as the piston moves. For example, the vent may be a hole in a wall of the piston tube, which the piston travels toward when it is caused to move by the compressed gas or fluid. The piston may travel past this hole so that the compressed gas or fluid located in the piston chamber may also escape through the vent.

Preferably, the payload ejection tube has an ejection opening at one end, through which the payload may be ejected from the ejection tube, the opening having a releasable cover. The cover may be releasable as a single piece or may be frangible so that breaking of the cover (e.g. upon an impact with the payload) releases it from the ejection opening. The cover may prevent water from entering the ejection tube e.g. if the system of the present invention is employed in a submarine.

The ejection element is preferably located at an opposite side of the payload to the ejection opening. Therefore, the ejection element may push the payload toward the ejection opening. The cable may extend from the ejection element, in a first direction, to a position adjacent the ejection opening, before travelling over the cable runner and into the piston tube, whereupon it may extend through the sealing means into the piston chamber and to the piston, in a second direction opposite the first direction. Thus, when the cable is entrained, the ejection element may apply a pushing force to the payload right up until the moment the payload is fully ejected from the ejection tube. This increases the speed at which the payload may be ejected from the ejection tube. When the cable is fixed to the ejection element and the piston, the ratio of the speed of movement of the piston and the ejection element may be 1:1.

As mentioned, however, the cable may pass over a pulley wheel mounted to the ejection element, instead of being fixed to the ejection element. The cable may extend, from the piston, over the pulley wheel to e.g. a position adjacent the ejection opening, where it is fixed or anchored. This configuration may allow a 2:1 ratio in the speed of movement of the piston and ejection element respectively. This increases the force that the ejection element may apply to the payload. Such an increase in force may be necessary for the payload to e.g. break the frangible cover of the ejection opening. To compensate for the resultant reduction in speed of the ejection element, the ejection tube and piston tube may be lengthened.

As has been mentioned above, the ejection element moves in the ejection tube to eject the payload from the ejection tube. It is preferable that a fluid flow path is provided into the ejection tube to allow fluid, e.g. water, to enter the ejection tube to the rear of the ejection element and the payload to enable the ejection tube to fill with fluid as the payload is ejected from the ejection tube. There may therefore be an opening in the ejection tube, which opening defines a fluid flow path between the interior and exterior of the ejection tube. It is then possible to use part of the ejection element to block that opening when the ejection element is in its rest position, prior to ejection of the payload. When the ejection element moves to eject the payload, the opening is unblocked and fluid can enter the interior of the ejection tube. Such an arrangement has the advantage that the unblocking of the opening and the ejection of the payload necessarily occur simultaneously. Such an arrangement, in which the ejection element blocks fluid opening in the ejection tube, may be used in combination with the first aspect of the invention discussed above.

However, it also represents a second aspect of the invention, because it can be used with arrangements in which the ejection element is moved by arrangements other than the cable system of the first aspect. Thus, a second aspect of the present invention may provide a payload deployment system for a vessel, the system including:

an ejection tube for holding a payload; and an ejection element in the ejection tube, the ejection element being arranged releasably to engage the payload, and being moveable in the ejection tube between a rest position, at which it is at a first distance from one end of the ejection tube, and a deployed position, at which it is at a second distance from said end of the ejection tube, the second distance being greater than the first distance;

wherein the ejection tube includes an opening in the surface thereof, which opening defines a fluid flow path between the interior and the exterior of the ejection tube;

wherein the opening is blocked by a part of the ejection element when the ejection element is in the rest position, and is unblocked when the ejection element is in the deployed position.

In such an arrangement, whether as an independent aspect or part of the first aspect, a further part of the ejection element engages the ejection tube and have at least one gap therein, to define a fluid flow path around the ejection element in the ejection tube. Thus, once fluid enters the opening in the ejection tube, it may flow not only into the space behind the ejection element and payload, but in front of the ejection element, thereby avoiding undesirable effects due to pressure differences.

It is desirable that the payload is retained in the ejection tube prevented moving except when it is to be ejected. Therefore, a retention latch may be provided moveable between a position in which it engages with the payload and a further position in which it is disengaged from the payload. The engagement of the retention latch may, for example, be with a projection on the payload which passes through the ejection element as discussed above. Then, fluid or compressed gas may be supplied to a release mechanism for the retention latch, which operates a release mechanism of the retention latch to cause the retention latch to move to its disengaged position, and so release the payload for subsequent ejection from the ejection tube.

Again, this feature may be used in combination with the first or second aspects of the invention discussed above, but it is an independent aspect. Thus, a third aspect of the present invention may provide a payload deployment system for a vessel, the system including:

an ejection tube for holding a payload, the ejection tube including retaining means arranged releasably to engage with the payload;

wherein the retaining means comprises:

a retention latch movable between a first position at which it is engaged with the payload and a second position at which it is disengaged from the payload, and a release mechanism operated by compressed gas or fluid connected to the retention latch;

and in that the system further includes means for supplying compressed gas or fluid to the release mechanism, thereby to operate the release mechanism;

wherein operation of the release mechanism is arranged to cause movement of the retention latch to the second position.

It is desirable that the mechanism for disengaging the retention latch from the payload is linked to the mechanism for ejecting the payload from the ejection tube. Thus, if such a retention latch is provided in combination with the first aspect of the invention, the compressed gas or fluid may be supplied simultaneously to the piston chamber and the retention latch release mechanism so that the disengagement of the retention latch from the payload occurs at the same time as the driving of the ejection element by the cable to eject the payload. However, this third aspect of the present invention may be used in arrangements which have deployment systems which do not use the cable arrangement of the first aspect, nevertheless it is still possible for the compressed gas or fluid to be linked both to the release mechanism for the retention latch and to the mechanism which ejects the payload.

The retention latch may operate on the basis of linear or rotational movement. In the latter case, the retention latch may, in a first position, engage projections on the payload, and may then rotate to a position in which such projections are free to move through openings in the retention latch, thereby to permit the payload to be ejected.

In the discussion of the third aspect above, the retention latch was controlled by a release mechanism which was operated by compressed gas or fluid. The rotating retention latch discussed above may similarly be driven by compressed gas or fluid, which compressed gas or fluid may also be used to drive the ejection mechanism for the payload, such as the cable-driven ejection mechanism of the first aspect.

However, it is possible for the rotating retention latch to be driven by a mechanism other than those using compressed gas or fluid, such as an electric motor. It thus represents an independent aspect of the present invention.

Thus, according to a fourth aspect of the present invention, there may be provided a payload deployment system for a vessel, the system including:

an ejection tube for holding a payload, the ejection tube including retaining means arranged releasably to engage with the payload;

wherein the retaining means comprises:

a retention latch rotatable between a first position at which it is engaged with the payload and a second position at which it is disengaged from the payload, and means for driving the retention latch to rotate it from the first position to the second position.

Such an arrangement may also be used in which the rotation of the retention latch also unblocks openings in the ejection tube, to permit fluid to enter therein. Instead of blocking those openings using part of the ejection element, as described with reference to the second aspect, the retention latch may have projections thereon which, when the retention latch is in the engage position, block openings in the ejection tube, which openings are unblocked when the retention latch moves to its disengaged position, thereby permitting fluid, such as water, to enter the ejection tube. Again, because the unblocking of the those openings in necessarily simultaneous with the release of the payload from engagement with the retention latch, the fluid can enter the ejection tube only when the payload is to be ejection from the ejection tube.

According to a further aspect of the present invention, there may be provided a vessel, e.g. a submarine, including the payload deployment system of the first second third and/or fourth aspects of the invention.

BRIEF DESCRIPTION OF THE DRAWINGS

Embodiments of the present invention will now be described with reference to the following drawings in which:

FIGS. 1 and 2 show a first embodiment of a torpedo deployment system for a submarine in accordance with the present invention. A torpedo 1 is located within an ejection tube 2. The ejection tube 2 has an ejection opening 21 at one end, through which the torpedo 1 may be ejected from the ejection tube 2. The ejection opening 21 is covered by a frangible cap 22. The torpedo 1 is held in a central position in the ejection tube 2 by guide members 23. The guide members 23 maintain spaces 24 between the torpedo 1 and the walls of the ejection tube 2 and also keep the ends of the ejection tube 2 apart.

A slidable ejection element 25 is located at an opposite end of the ejection tube to the ejection opening 21. The ejection element 25 is slidable towards the ejection opening 21 along substantially the entire length of the tube. The ejection element 25 has a profile that conforms with the internal walls of the ejection tube 2. However, So that the guides 23 do not obstruct sliding of the ejection element 25, the ejection element 25 has corresponding cut-out portions (not shown). The ejection element 25 has an engagement surface 26 for releasably engaging the torpedo 1. As shown in FIG. 1, the engagement surface 26 releasably engages the rear end of the torpedo 1. Thus, when, in use, the ejection element 25 slides along the ejection tube 2, the torpedo 1 is forced (pushed) out of the ejection tube 2 by the ejection element 25.

Figure 1:
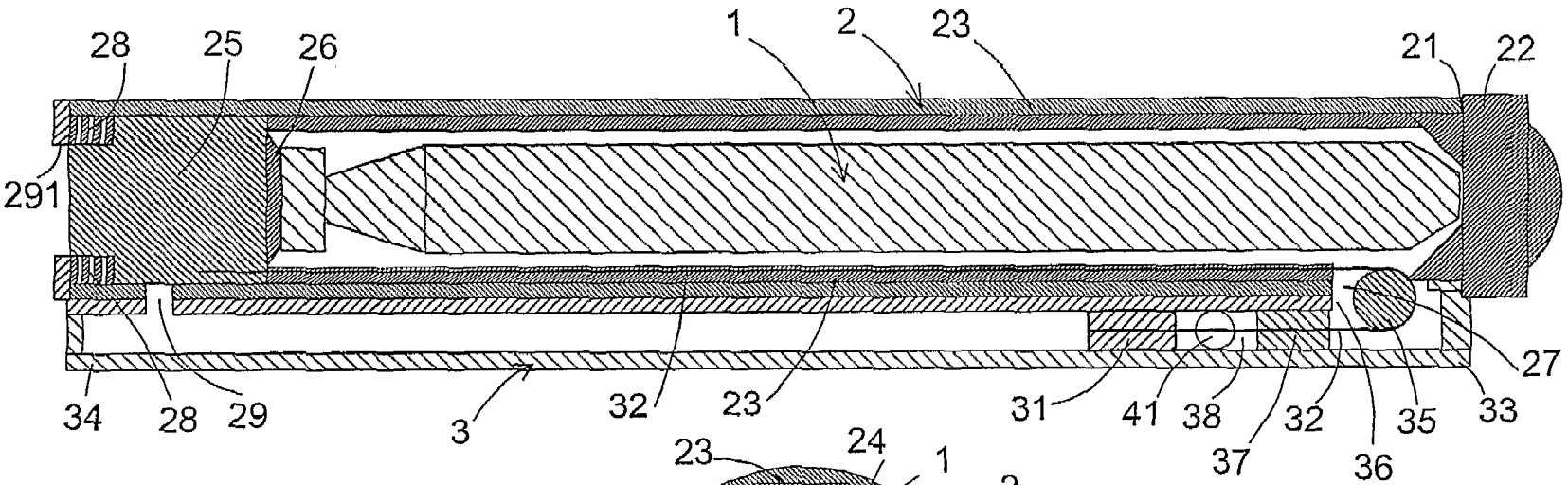
FIG. 1 is cross-sectional side view of a payload deployment system according to a first embodiment of the present invention.
Figure 2:
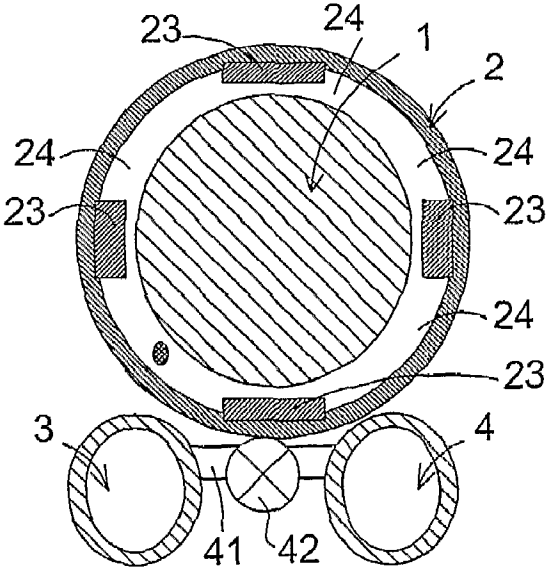
FIG. 2 is a cross-sectional front view of the payload deployment system of FIG. 1.

A drive means is provided to slide the ejection element 25 in the ejection tube 2. The drive means comprises a piston 31 located in a piston tube 3, the piston being connected to the ejection element 25 by a cable 32.

The piston tube 3 is substantially the same length as the ejection tube 2, and is mounted to one side of the ejection tube 2. The axis of the ejection tube 2 and the piston tube 3 are parallel.

The piston tube 3 has a first end 33 and a second end 34, the first end 33 being adjacent to the ejection opening 21 of the ejection tube 2. The piston 31 is arranged to move toward the second end 34 upon the application of fluid pressure. To enable this, the piston tube 3 is connected, via a tube 41, having a firing valve 42 therein, to a compressed air vessel 4. The arrangement is such that, upon release of the firing valve 42, compressed air flows into a piston chamber 38 in the piston tube 3 that is defined at one end by the piston 31. Essentially, release of the firing valve 42 launches the torpedo 1.

The piston chamber 38 has a sealing element 37 that defines an opposite end of the piston chamber to the piston 31. The sealing element 37 has a hole therein through which the cable 32 passes into the piston chamber 38 in a sealed manner. The sealing element 37, prevents compressed air leaking from the piston chamber 38.

A cable runner 35 (essentially a wheel) is located at the first end 33 of the piston tube 3. The wheel projects into the interiors of both the piston tube 3 and the ejection tube 2 via adjacent openings 36, 27 of the piston tube 3 and the ejection tube 2 respectively.

The cable 32 runs from the piston 31, through the piston chamber 38 and through the sealing element 37 (in a left to right direction as shown in FIG. 1), over the cable runner 35 and then through the interior of the ejection tube 2 (in right to left direction as shown in FIG. 1), to the ejection element 25. The cable 32 runs through the ejection tube 2 in one of the spaces 24 between the torpedo 1 and the walls of the ejection tube 2.

When the piston 31 slides in a direction from right to left, as shown in FIG. 1, the ejection element 25 is caused to slide in the opposite direction, i.e. from left to right, as shown in FIG. 1, due to a pulling force applied to the ejection element 25 by the cable 32. This causes the ejection element 25 to push the torpedo 1 toward the ejection opening 21, whereupon the torpedo 1 applies force to the frangible cap 22, causing it to break. By breaking, the frangible cap 22 no longer obstructs the opening 21, and ejection of the torpedo 1 from the ejection tube 2 may therefore take place. The frangible cap 22 is weighted so that it falls to the seabed upon breaking.

To prevent the ejection element 25 sliding unintentionally, e.g. as a result of movement of the submarine, the ejection element 25 is releasably fixed to the walls of the ejection tube 2 via frangible blocks 28. Unintentional sliding of the ejection element 25 might damage the torpedo 1 or might even cause the torpedo 1 to be ejected from the ejection tube 2 when this is not desired. Movement of the piston 31 upon application of fluid pressure applies sufficient force to the ejection element 25 for the frangible blocks 28 to break, allowing the ejection element 25 to eject the torpedo 1 when desired.

The piston tube 3 includes a vent 29 which is arranged to vent air that is compressed by the piston as it moves toward the second end 34 of the piston tube 3. The vent 29 is located between the piston 31 and the second end 34 of the piston tube 3. The vent 29 is provided by adjacent holes in the walls of the piston tube 3 and the ejection tube 2. The ejection tube 2 includes an aft opening 291, through which the air may vent from the ejection tube 2. In FIG. 1, the aft opening 291 and the vent 29 are shown as being blocked by the ejection element 25. However, when the piston 31 moves toward the second end 34 of the piston tube 3, the ejection element 25 will cease to block the vent 29 and aft opening 291, since the ejection element 25 will move toward the ejection opening 21, as described above.

Figure 3:
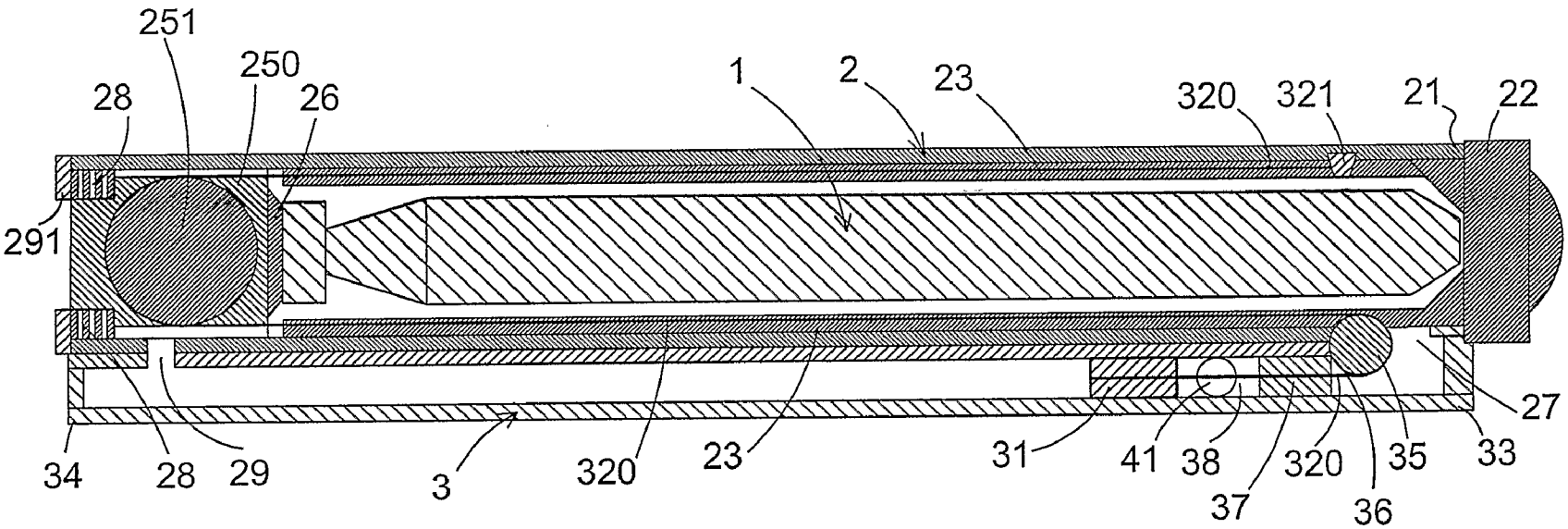
FIG. 3 is a cross-sectional side view of a payload deployment system according to a second embodiment of the present invention.

FIG. 3 shows a second embodiment of a torpedo deployment system for a submarine in accordance with the present invention. Features of this second embodiment that are the same as features in the first embodiment have been given the same reference numerals and are not described again. The system of the second embodiment is almost identical to the system of the first embodiment, except for the configuration of the ejection element and the manner in which the cable interacts with the ejection element.

In the second embodiment, the ejection element 250 includes a rotatably mounted pulley wheel 251. The cable 320 extends from the piston 31, via the cable runner 35, to the ejection element 250 in a similar manner to the first embodiment. However, rather than being fixed to the ejection element 250, the cable 320 travels over the pulley wheel 251 and doubles back along the ejection tube 2, whereupon the cable 320 is fixed by an anchor element 321 to the ejection tube 2 at a position adjacent the opening 21 of the ejection tube 2.

As in the first embodiment, when, in use, the piston 31 slides in a direction from right to left, as shown in FIG. 3, the ejection element 250 slides in the opposite direction, i.e. from left to right. This is due to a pulling force applied to the ejection element 250 by the cable 320. However, since the cable 320 passes over the pulley wheel 251 and is anchored to the ejection tube 2 as described above, rather than being fixed to the ejection element 250, the ejection element 250 will move at half the speed of the piston 31. As a result, the ejection element 250 will apply twice the force to the torpedo 1, which means that, accordingly, the torpedo 1 will strike through the frangible cap 22 with greater force. Therefore, the frangible cap 22 may be made stronger than in the first embodiment, reducing the chance that it will break accidentally.

A third embodiment of the present invention will now be described with reference to FIGS. 4*a* to 4*e*, 5 and 6. Many features of this third embodiment are similar to those of the first and/or second embodiment and are indicated by corresponding reference numerals. Moreover, detailed descriptions of corresponding parts is omitted, to avoid repetition. The third embodiment differs from the first and second in some details of the cable arrangements, and also in the arrangements for ensuring appropriate flooding of the ejection tube 2. Thus referring to FIG. 4*a*, in this third embodiment the cable 32 passes around a guide block 50, rather than around a circular cable runner 35, on entry to the piston tube 3 prior to passing through the sealing element 37 on its path to the piston 31.

Moreover, the ejection element 350 is hollow and contains a retention latch 52 which is connected to a release mechanism 54, which release mechanism 54 is connected to the valve 42 via a duct 56. When in the position shown in FIG. 4*a*, the ejection element 350 also seals an opening 58, with the sides of that opening 58 being sealed to the ejection element 350 by seals 60. The opening 58 communicates with the exterior to permit a water path to be created, as will be described later.

Figure 4A:
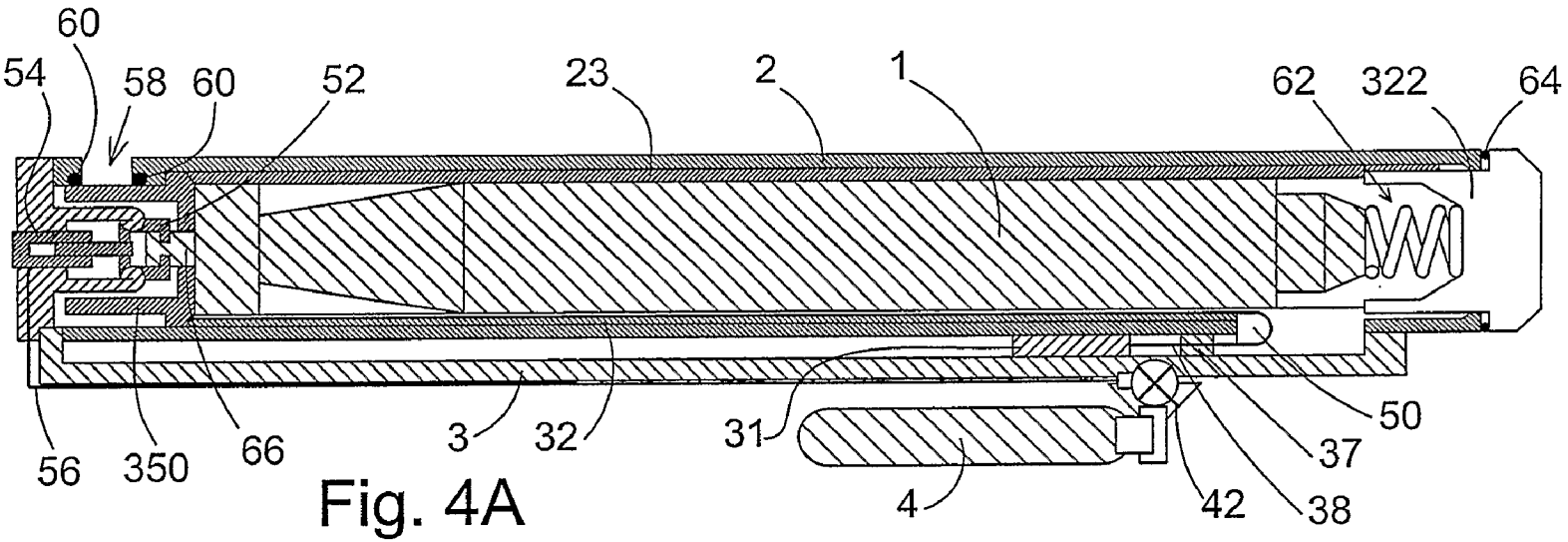
FIGS. 4*a* to 4*e* are cross-sectional views of a payload deployment system according to a third embodiment of the invention, in different stages in the ejection of that payload.

FIG. 4*a* also shows that between the front of the torpedo 1 and the end cap 322 is a spring shock absorber 62. Moreover, front cap 322 is connected by a frangible seal 64 to the walls of the ejection tube 2.

Figure 4B:
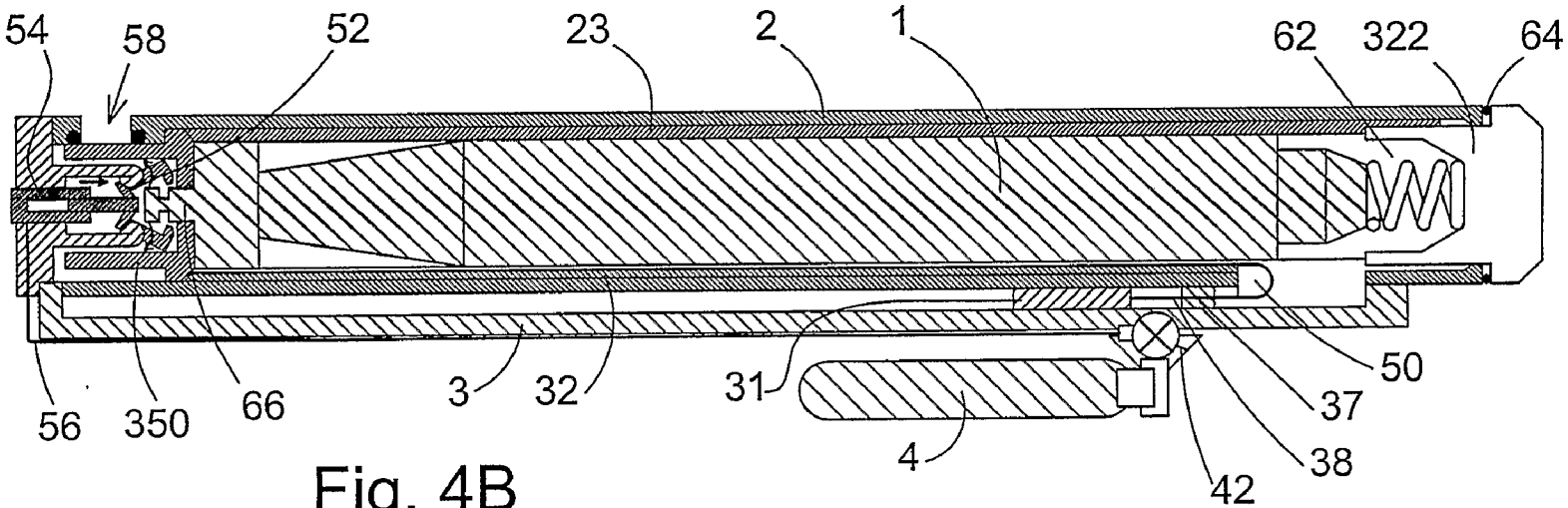

In order to launch the torpedo 1 from the ejection tube 2, the first stage is that the release mechanism is primed. As shown in FIG. 4*b*, the valve 42 is activated to cause pressurised fluid to pass through the duct 56 to the release mechanism 54, thereby releasing the retention latch 52 from the connector 66, which connector 66 is connected to the end of the torpedo 1. At this stage, the valve 42 does not permit compressed air to reach the piston chamber 38 and the opening 58 is still sealed by the ejection element 350.

Figure 4C:
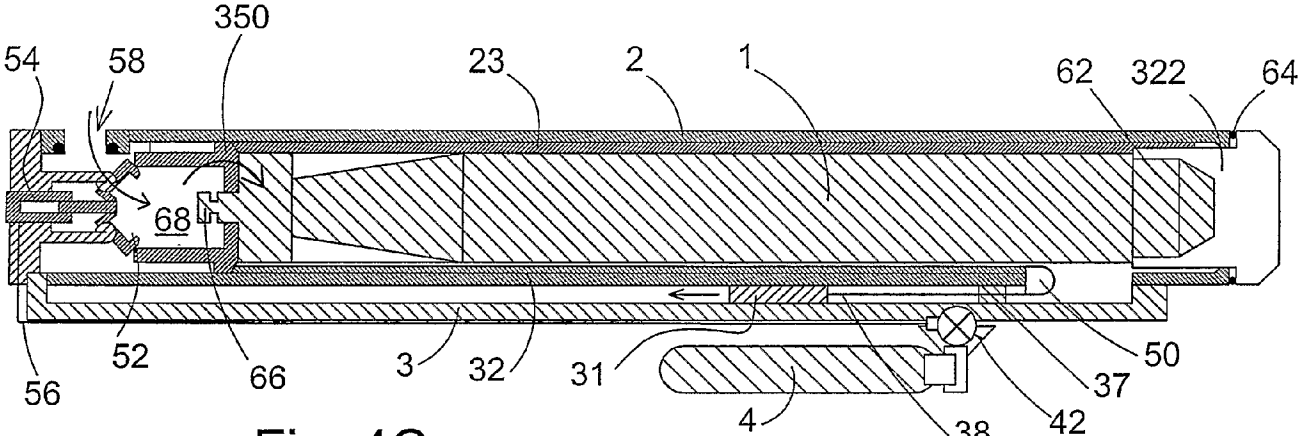

In the next stage, illustrated in FIG. 4*c*, the firing valve 42 causes pressurised air to enter the piston cylinder 38, thereby moving the piston 31 leftwards in FIG. 4*c*. The action of the cable 32 then moves the ejection element 350 to the right in FIG. 4*c*. This movement means that the opening 58 is no longer sealed by the ejection element 350 and water passes through that opening 58 into the hollow interior 68 of the ejection element 350, behind the torpedo 1. Note that, at this stage, the cap 322 is still in place, and the frangible seal 64 still intact.

Figure 4D:
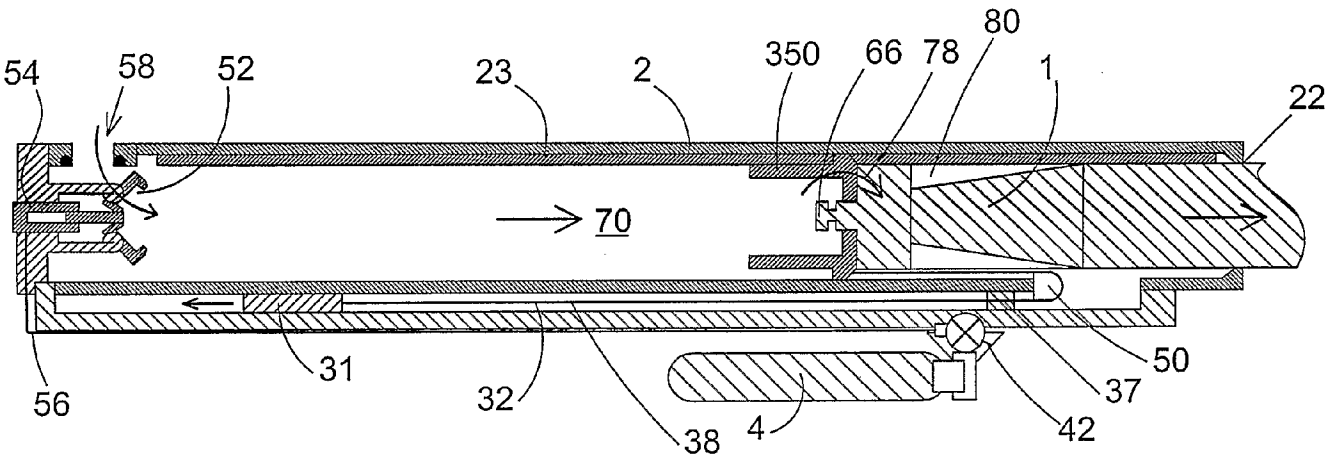

However, as the piston 31, cable 32, ejection element 350 and torpedo 1 continue to move, the frangible seal 64 is broken and the cap 322 is expelled from the opening 22 of the ejection tube 2. Thus, the position shown in FIG. 4*d* is reached. Water continues to enter via the opening 58, flooding the space 70 created within the ejection tube 2 behind the ejection element 350. Note that the ejection element 350 is still engaged with the torpedo 1, because of the force due to the cable 32, and also because of engagement between the ejection element 350 and the connector 66. The water fills the volume behind the torpedo to ensure that pressure effects do not impede the launching of the torpedo. Note also that the cap 322 may be weighted so that it falls clear of the ejection tube 2 once the frangible seal 64 breaks.

Figure 4E:
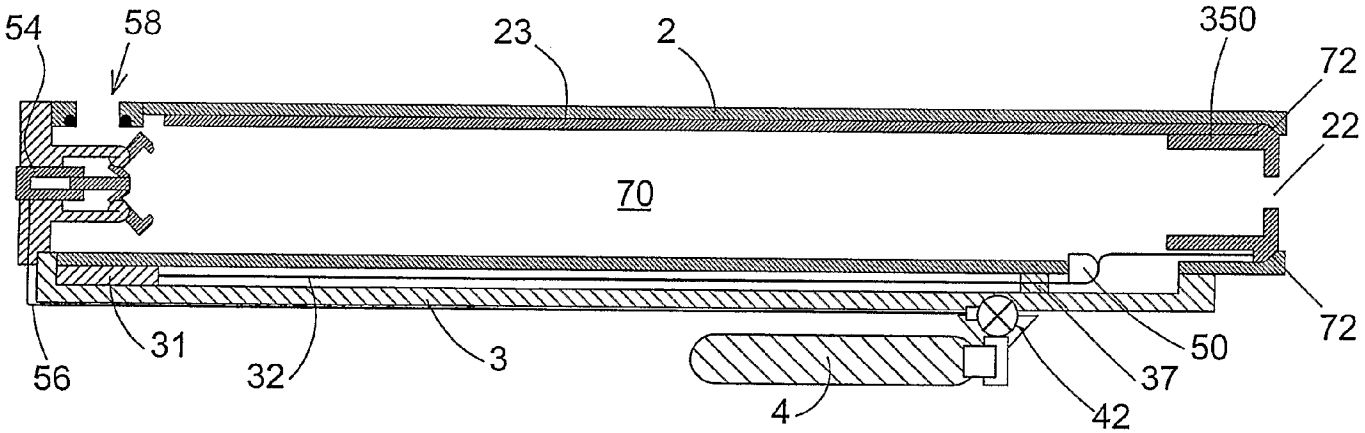

Finally, the stage shown in FIG. 4*e* is reached. The torpedo 1 has passed from the ejection tube 2 and is released. The ejector element 22 contacts flanges 72 around the opening 22 and so is held within the ejection tube 2. Substantially the whole of the space 70 corresponding to the interior of the ejection tube 2 is now filled with water.

Figure 6:
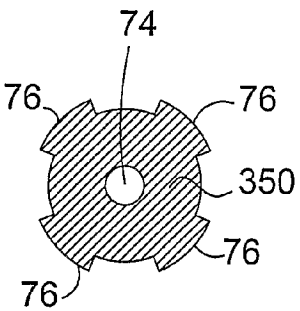
FIG. 6 is a front view of an ejection element used in the third embodiment.
Figure 5:
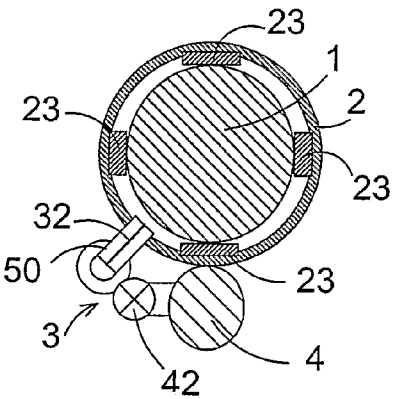
FIG. 5 is a front view of the payload deployment system of FIGS. 4*a* to 4*e;*

FIG. 5 shows a cross-sectional view of the arrangement of FIGS. 4*a* to 4*e*, illustrating how the guide members 23 are arranged around the torpedo 1. FIG. 6 shows an end view of ejection element 350 illustrating the opening 74 into which the connector 66 is received, and also shows that the ejection element 350 may have projections 76 thereon which will engage with the flanges 72. Note that the projections 76 have the effect of creating a flowpath for water around the ejection element. Thus, in the position in FIG. 4*d*, for example, water may pass from the space 70 around the ejection element 350 as shown by arrow 78 into the space 80 within the ejection tube 2 around the torpedo 1. Thus, again, pressure may be equalised.

In the third embodiment discussed with reference to FIGS. 4 to 6, the torpedo 1 is held by the retention latch 52, except when the torpedo 1 is to be ejected from the ejection tube 2. The retention latch illustrated in FIGS. 4*a* to 4*e* has arms which engage the connector 66, the ends of which arms move outwardly to release that connector 66.

Figure 7:
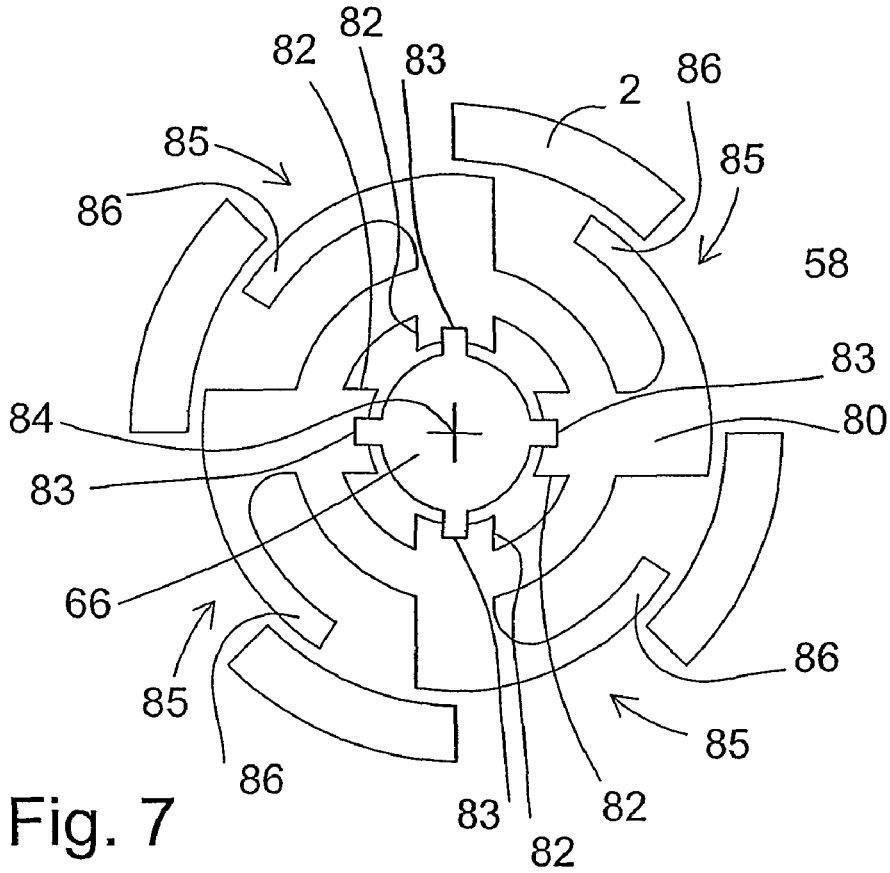
FIG. 7 illustrates a modified release mechanism for use in the third embodiment, that release mechanism being in an engaged position.

However, it is possible for the retention latch to operate on the basis of rotation. Thus, FIG. 7 illustrates an alternative configuration of the retention latch, in which that latch is in the form of a disk 80 with an opening 81 therein through which passes the connector 66. In this arrangement, the retention latch 80 has projections 82 which extend inwardly in the opening 80, and in the retention position shown in FIG. 7, engage projections 83 on the connector 66. Thus, the torpedo 1 is held in the ejection tube 2.

Figure 8:
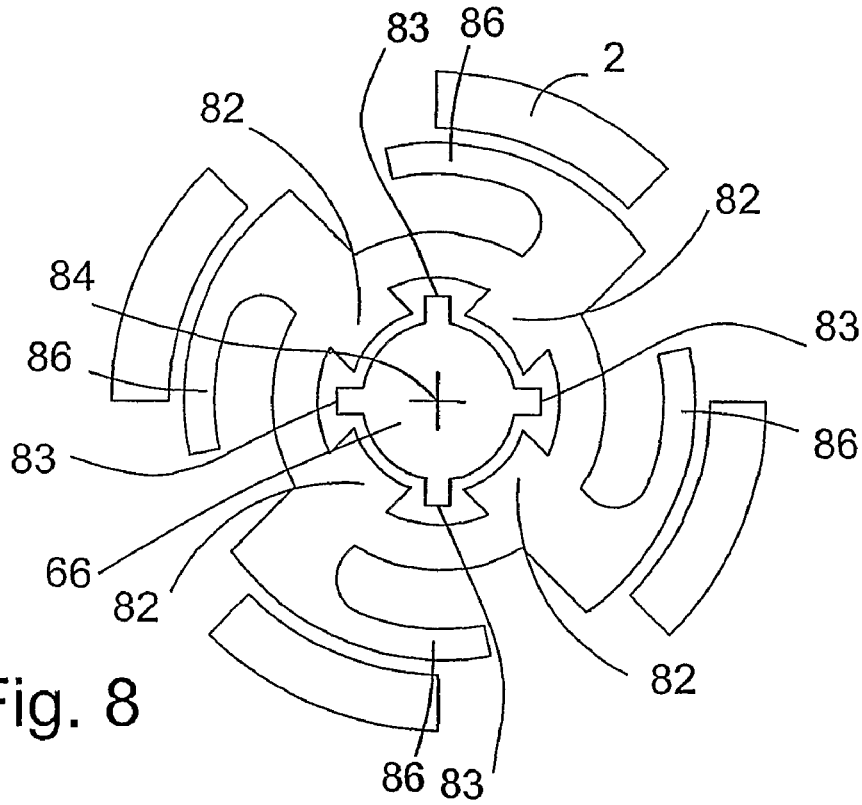
FIG. 8 shows the release mechanism or FIG. 7, but in the disengaged position.

When the torpedo 1 is to be released, the retention latch 80 rotates about axis 84 to the position shown in FIG. 8 in which the projections 83 on the connector 66 are aligned with the gaps between the projections 82. Thus, the connector 66 is disengaged from the retention latch 80, and hence the torpedo 1 is free to move in the ejection tube 2.

The rotation of the retention latch 80 may be driven by compressed gas or fluid, as in the arrangements illustrated in FIGS. 4*a* to 4*e*. Also as in those arrangements, the compressed gas or fluid may be supplied from the compressed air vessel 4 which drives the piston 31.

FIGS. 7 and 8 illustrate another modification of the third embodiment. In the arrangements illustrated in FIGS. 4*a* to 4*e*, the opening 58 is blocked by the ejection element 350 until that ejection element 350 moves as part of the operation of ejecting the torpedo 1. In the arrangements shown in FIGS. 7 and 8, there are openings 85 in the ejection tube 2, and the release latch 80 has outwardly extending projections 86. When the ejection element 80 is in the engaged position, illustrated in FIG. 7, those outwardly extending projections 86 block the openings 85. However, as can be seen from FIG. 8, when the retention latch 80 rotates to release the connector 66, the outwardly extending projections 86 move to a position where they are clear of the openings 85, thus permitting fluid to enter through those openings 85 into the ejection tube 2.

The invention claimed is:

1. A payload deployment system for a vessel, the system including:

an ejection tube for holding a payload;

an ejection element in the ejection tube, the ejection element being moveable in the ejection tube and being arranged releasably to engage the payload;

a piston tube containing a piston, being located outside of the ejection tube, and defining a piston chamber on one side of the piston, the piston being moveable in the piston tube;

means for supplying compressed gas or fluid to the piston chamber, thereby to move the piston in the piston tube; and a cable which extends between the piston and the ejection element, the cable passing through an aperture of the piston tube into the piston chamber; and wherein the movement of the piston is arranged to cause movement of the cable which causes movement of the ejection element in the ejection tube, thereby to eject the payload from the ejection tube;

wherein the ejection element is moveable in the ejection tube between a rest position, at which the piston chamber is vacant of said compressed gas or fluid, and a deployed position, at which said piston chamber contains said compressed gas or fluid;

wherein the ejection tube includes an opening in the longitudinal surface thereof, which opening defines a fluid flow path between the interior and the exterior of the ejection tube; and wherein the opening is blocked by a further part of the ejection element when the election element is in the rest position, and is unblocked when the ejection element is moved from the rest position to eject the payload to allow fluid flow between the interior and exterior.

2. A payload deployment system according to claim 1, wherein the cable is fixed to the piston.

3. A payload deployment system according to claim 1, wherein the cable is fixed to the ejection element.

4. A payload deployment system according to claim 1, wherein the cable is fixed to the ejection tube and part of the cable between the piston and the fixing to the ejection tube engages with the ejection element.

5. A payload deployment system according to claim 4, wherein the engagement with the ejection element is via a pulley rotatably mounted on the ejection element.

6. A payload deployment system according to claim 1, wherein the piston tube is fixed relative to the ejection tube.

7. A payload deployment system according to claim 1, including a second opening in the ejection tube and a third opening in the piston tube, which third opening is located on the opposite side of the aperture from the piston, wherein part of the cable passes through the first and third openings.

8. A payload deployment system according to claim 7, including a cable runner located in or adjacent to the second and third openings, wherein part of the cable passes around the cable runner such that the path of the cable is changed by the cable runner, the path of the cable from the ejection element to the second opening in the ejection tube being in the opposite direction from the path of the cable from the third opening in the piston tube to the piston.

9. A payload deployment system according to claim 8, wherein the cable runner is a wheel.

10. A payload deployment system according to claim 1, further including a sealing element in the piston tube through which the cable passes, the sealing element having a profile that conforms with the inner walls of the piston tube, whereby said compressed gas or fluid is deliverable between the sealing element and the piston.

11. A payload deployment system according to claim 1, wherein a part of the ejection element engages the ejection tube and said part has at least one gap therein thereby to define a fluid flow path around the ejection element in the ejection tube.

12. A payload deployment system according to claim 1, wherein the ejection tube includes a retention latch arranged releasably to engage with the payload.

13. A payload deployment system according to claim 12, wherein said retention latch is disengaged from the payload when a duct between said means for supplying compressed gas or fluid and a release mechanism connected to the retention latch contains said compressed gas or fluid.

14. A payload deployment system according to claim 1, wherein a vent is located in the piston tube on the opposite side of the piston from the piston chamber.

15. A payload deployment system according to claim 1, wherein the ejection element is releasably fixed to the walls of the ejection tube via frangible blocks.

* * * * *

UNITED STATES PATENT AND TRADEMARK OFFICE

CERTIFICATE OF CORRECTION

PATENT NO. : 7,997,224 B2
APPLICATION NO. : 12/091198
DATED : August 16, 2011
INVENTOR(S) : Owen et al.

It is certified that error appears in the above-identified patent and that said Letters Patent is hereby corrected as shown below:

On the Title Page change Item (22) from "PCT Filed: Oct. 24, 2006"

to --PCT Filed: Oct. 23, 2006--.

Signed and Sealed this
Twentieth Day of December, 2011

David J. Kappos

David J. Kappos
*Director of the United States Patent and Trademark Office*